US006371072B1

(12) United States Patent
Huber

(10) Patent No.: US 6,371,072 B1
(45) Date of Patent: Apr. 16, 2002

(54) METHOD AND APPARATUS FOR MOUNTING A TRUCK ACCESSORY POWER UNIT

(76) Inventor: Larry Joseph Huber, 3179 Donny Cave La., Maryland Heights, MO (US) 63043

( * ) Notice: Subject to any disclaimer, the term of this patent is extended or adjusted under 35 U.S.C. 154(b) by 0 days.

(21) Appl. No.: 09/643,367

(22) Filed: Aug. 22, 2000

(51) Int. Cl.[7] ..... F02F 7/00
(52) U.S. Cl. ..... 123/195 A; 123/198 C
(58) Field of Search ..... 123/195 A, 198 C

*Primary Examiner*—Noah P. Kamen

(74) *Attorney, Agent, or Firm*—Haverstock, Garrett & Roberts LLP; Bruce E. Burdick

(57) ABSTRACT

A method of installing a belt driven accessory on an internal combustion engine in which consists in an OEM dual alternator installation having two OEM alternator mounting brackets, each bracket configured to receive an alternator. The accessory is attached to an adapter. The adapter is attached, with the accessory attached thereto, to one of the two alternator mounting brackets, in place of an alternator which might have otherwise been attached to said one bracket; and a single drive belt is placed in operative position to drive the accessory attached to one OEM alternator mounting bracket and an alternator attached to the other OEM alternator mounting bracket.

7 Claims, 4 Drawing Sheets

METHOD AND APPARATUS FOR MOUNTING A TRUCK ACCESSORY POWER UNIT

BACKGROUND OF THE INVENTION

This invention relates to motor vehicles and more particularly to methods and apparatuses for mounting accessory power units in motor vehicles.

Utility company, construction, tree service, and other similar light and medium-duty trucks, including vans are often fitted with hydraulic lifts or other devices powered by an internal combustion engine of the trucks. One of the best selling vehicles for such applications is a FORD® truck, for example with a FORD® 250–550 Direct Injected Intercooled Diesel. FORD® trucks, like most motor vehicles, are produced in assembly plants and subsequently modified by truck service centers. Truck service centers currently mount accessory hydraulic pumps by use of accessory mounting kits which utilize many non-FORD® parts, including additional pulleys, complex brackets, extra belts in non-standard positions and shaft extensions. One example of such a conventional mounting system is the FMK 66-2 Belt Kit, for 1999 FORD® produced by CW Mill Equipment Co., Inc. of Sabetha, Kans. The CW Mill installation kit calls for more than 30 different parts, many non-standard. Installation of the CW Mill kit requires removing the alternator, removing the power steering pump, removing and replacing the power steering pump bracket, pulling and reinstalling the power steering pump pulley, adding a second drive belt and bolting a special pulley to the harmonic balancer, and numerous other operations. New trucks usually come with a manufacturer's warranty, and the current truck engine accessory mounting systems with extra non-standard parts and non-standard belt positions may void the engine warranty, thus leaving the installer and the mounting kit manufacturer at possible liability for the engine warranty voided by the installation. This added risk is passed on to the customer in the form of a high installation charge. The manufacturer's warranty, particularly on the engine, is very important to dealers, repairmen and customers because the cost of major engine repairs is high. For engine repairs, trucks with current accessory kits installed may have to be taken to a particular service center that handles that particular mounting kit, especially in view of the above noted warranty risks. That service center may not be nearby when the truck engine needs servicing. The complexity of current accessory mounting kits requires a substantial amount of labor for installation, such as for example about 6–8 hours, which adds further cost to the initial installation and any subsequent repair.

There is a need for an accessory mounting system that minimizes the use of non-standard parts and which minimizes the chance of voiding an OEM engine warranty.

BRIEF SUMMARY OF THE INVENTION

In an exemplary embodiment, a method of installing a belt-driven accessory on a truck engine is provided which utilizes a simple special bracket and existing OEM parts. A typical situation where that might be desirable is in a truck having a hydraulic lift (not shown) needing a hydraulic fluid pump. The installation of the belt-driven accessory is done by use of a conventional dual alternator mounting modified by substituting for one of dual alternators a special mounting bracket adapted to attach to both the belt-driven accessory and one of the dual alternator mounts. The installation places the pulley of the accessory in the position where an alternator pulley would normally have been. This makes the addition of a hydraulic pump less complicated and can be done with all OEM parts except the adapter, adapter bolts and accessory. The manufacturer's warranty should thus be unaffected and the installation time and cost are reduced from current systems.

DETAILED DESCRIPTION OF THE INVENTION

Figure 1:
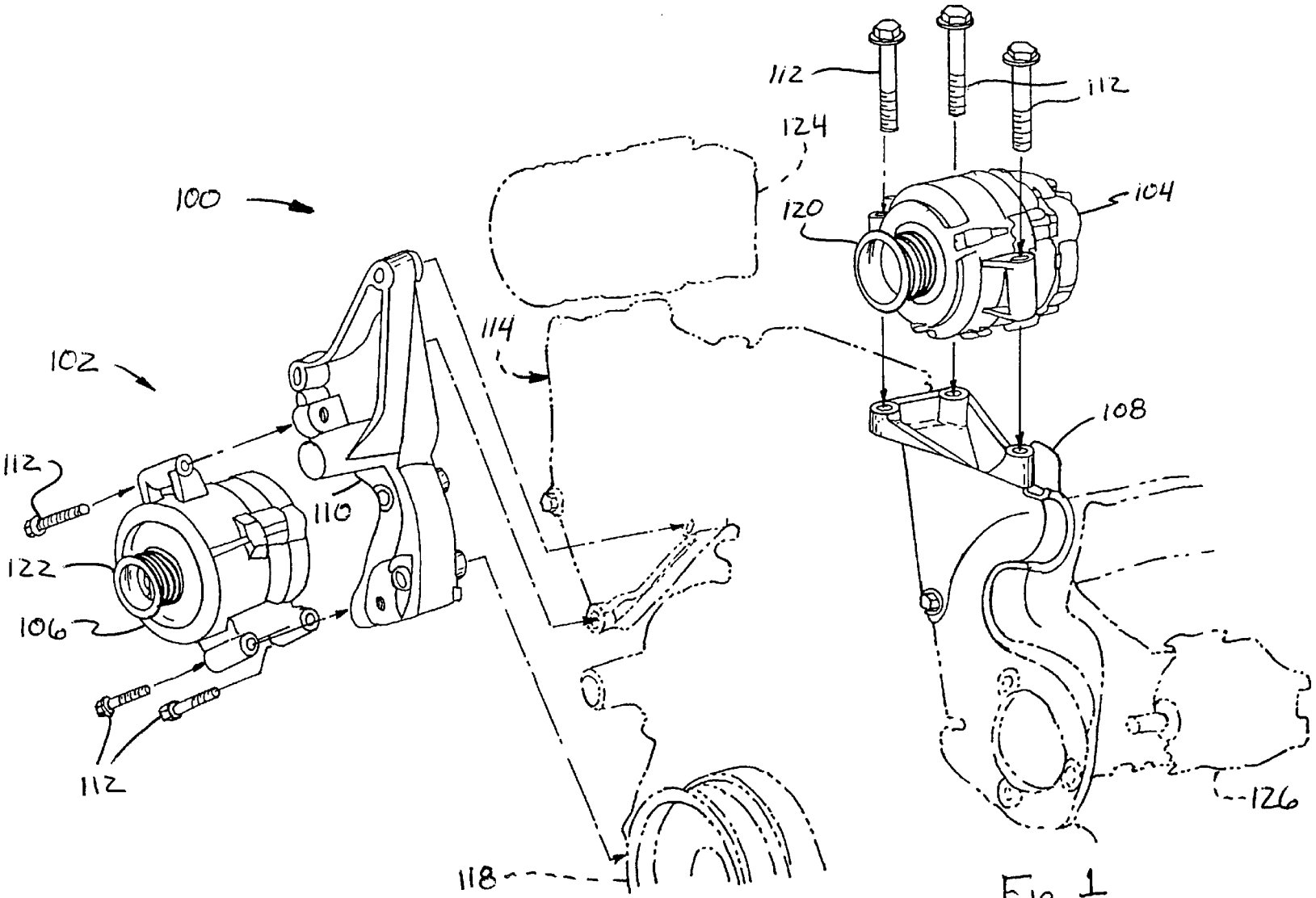
FIG. 1 is a perspective exploded view of an exemplary truck engine with a standard FORD® dual alternator installation.

"OEM" means a motor vehicle part that is manufactured to the specifications of the original equipment manufacturer. Normally this means the part is made by or for the original equipment manufacturer. FIG. 1 is a perspective exploded view of an exemplary conventional truck engine 100 with a standard FORD® OEM dual alternator installation 102 including a first standard alternator 104 and an optional second alternator 106. All parts in FIG. 1 are OEM. Standard alternator 104 is mounted on a standard alternator-power steering bracket 108 and affixed to bracket 108 by three alternator bolts 112. Optional alternator 106 is mounted on an optional alternator bracket 110 and affixed to bracket 110 by three alternator bolts 112. Bracket 110 is, in turn, affixed to the front 114 of block 116 of engine 100. A flexible belt or chain (not shown) is subsequently placed around a crankshaft pulley 118, a pulley 120 on alternator 104 and a pulley 122 on alternator 106 to power alternators 104 and 106. The belt or chain may also power other components such as an air conditioning compressor 124 and a power steering pump 126.

Figure 2:
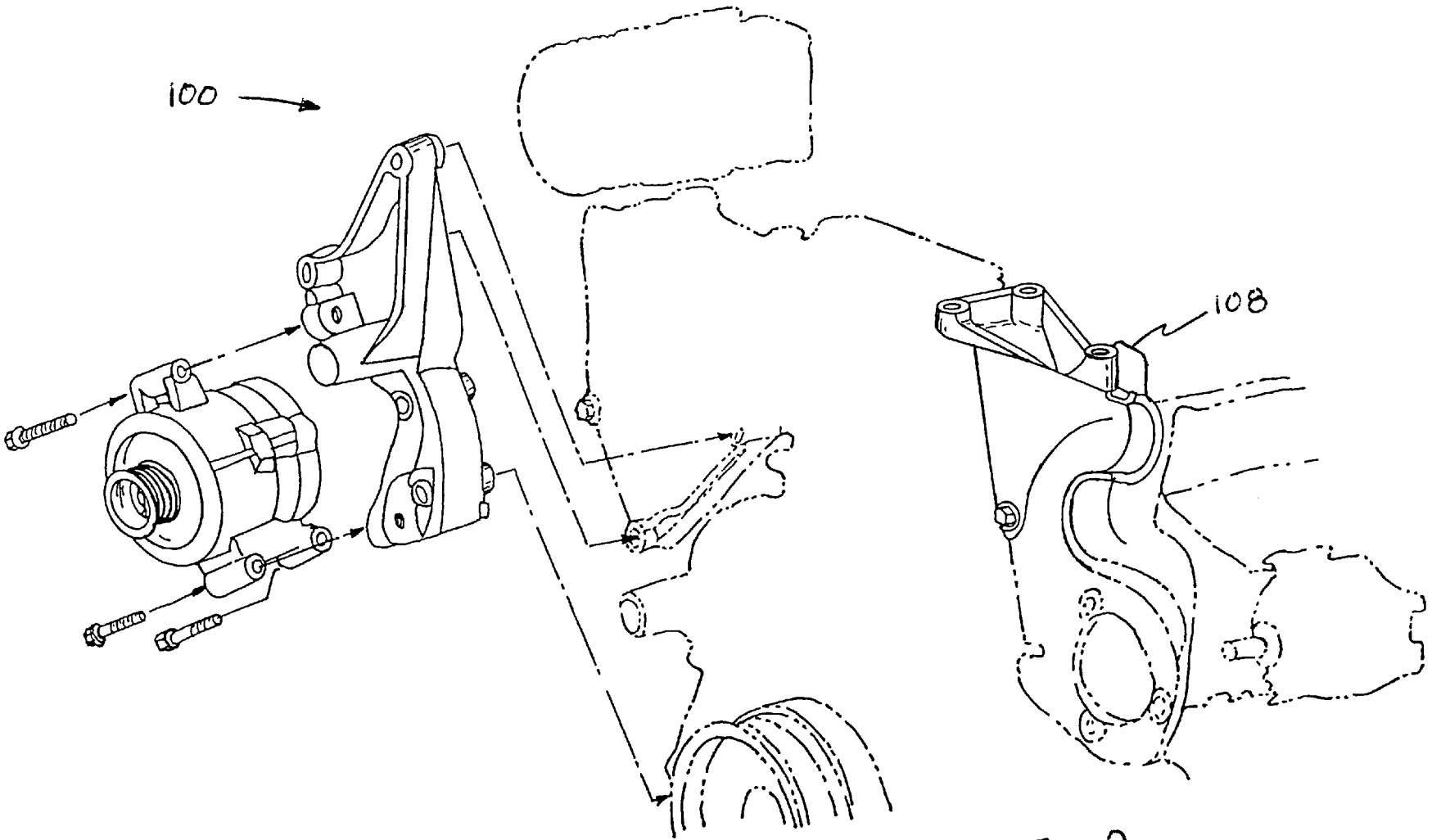
FIG. 2 is a perspective exploded view of the exemplary truck engine of FIG. 1 with one of the dual alternators removed.

FIG. 2 is a perspective exploded view of engine 100 with alternator 104 removed from bracket 108 in preparation for installation of an alternate exemplary mounting adapter and accessory (described below). The simplicity of this removal is apparent. As in FIG. 1, all parts are still OEM.

Figure 3:
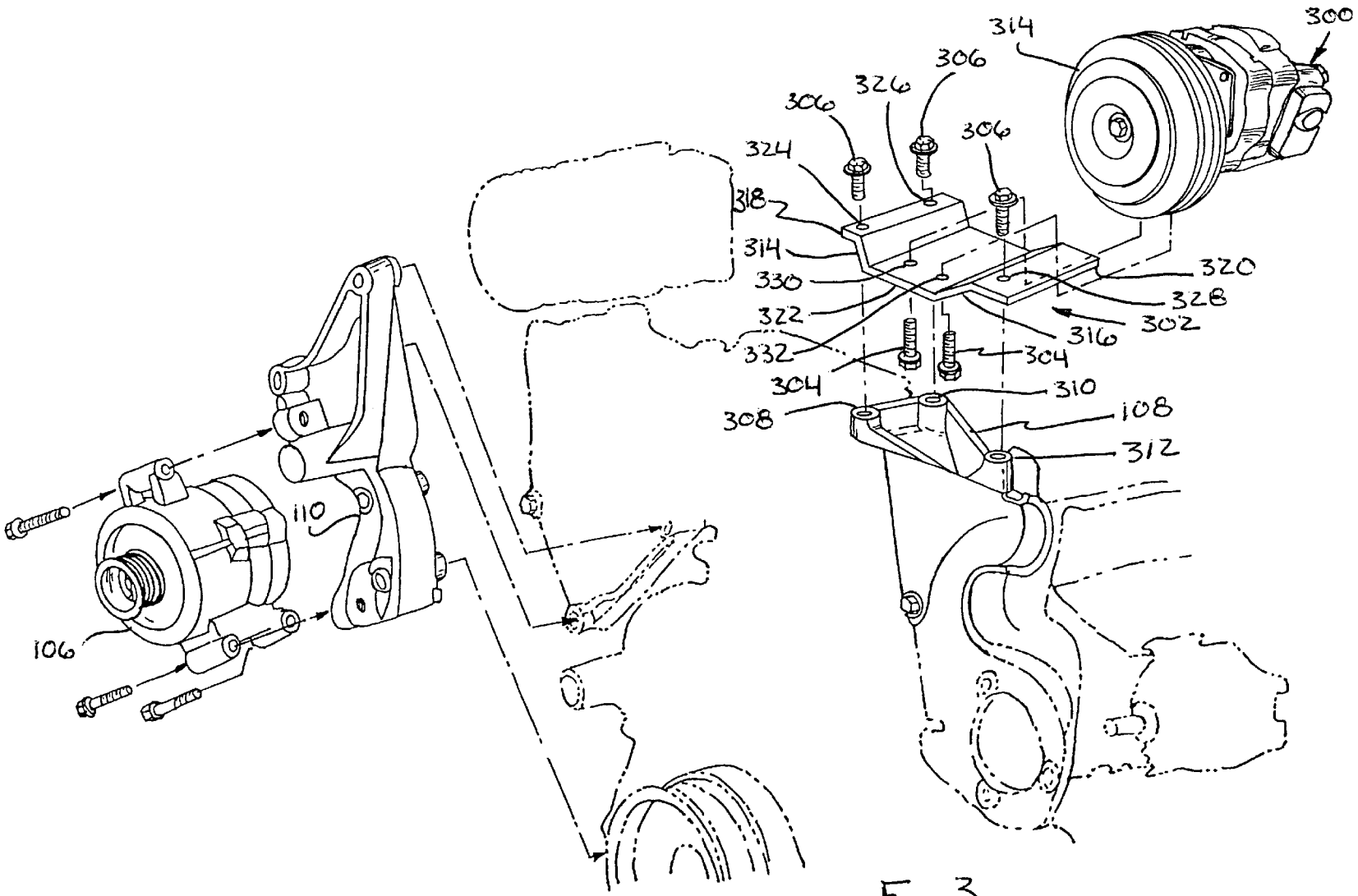
FIG. 3 is a perspective exploded view of the engine of FIG. 2 with an exemplary accessory mounting bracket installation.

FIG. 3 is a perspective exploded view of engine 100 with exemplary optional alternator bracket 110, but with a belt-driven hydraulic pump 300 mounted on an exemplary accessory adapter 302 by two accessory mounting bolts 304. Adapter 302 is, in turn, mounted on bracket 108 by three adapter mounting bolts 306, which are configured to thread into three bolt holes 308, 310, and 312 already existing in OEM bracket 108. It will be understood that pump 300 and adapter 302 could instead be mounted on optional bracket 110 in place of optional alternator 106. If adapter 302 is mounted on bracket 110, standard alternator 104 is be mounted on bracket 108. It is preferred to place pump 300 and adapter 302 on bracket 108 to allow any hydraulic hoses and fittings to be more easily installed. The exemplary installation of FIG. 3 shows the simplicity of the mounting in contrast with the prior art C.W. Mill installation. The only non-OEM parts in FIG. 3 are bracket 302, bolts 304 and 306, and pump 300. Pump 300 has a pulley 314 that would be driven by a standard serpentine belt (not shown) in similar fashion to the manner in which pulley 120 was driven. Pulley 314 is aligned with pulleys 118 and 122, since pulley 314 occupies the space previously occupied by pulley 120.

The use of bracket 302 permits a simple method of installing belt-driven accessory 300 on truck engine 100. A typical situation where that might be desirable is in a truck having a hydraulic lift (not shown) needing hydraulic fluid pump 300. Conventional dual alternator mounting 102 is modified by substituting for one of the two alternators 104,106 adapter 302 adapted to attach to both accessory 300 and one of the dual alternator mounts 106, 108. Adapter 302 makes the addition of a hydraulic pump an easy assembly using all OEM parts except adapter 302, adapter bolts 306 and accessory 300. One exemplary accessory installation method is to order a truck with a dual alternator installation 102. The standard alternator 104 is then be removed in conventional manner by loosening or removing the serpentine belt (not shown) from alternator 104, unbolting bolts 112, and lifting alternator 104 out of bracket 108. Accessory 300 is bolted to adapter 302 using two accessory mounting bolts 304 and adapter 302 and accessory 300, as a unit, are mounted in bracket 108 by three adapter mounting bolts 306. Adapter 302 is configured to align pulley 314 in the same plane as was pulley 120. Two 3.5" diameter back idler pulleys (not shown) are replaced by two 3" diameter OEM back idler pulleys to help compensate for the increased size of pulley 314 relative to pulley 120. The drive belt is then tightened back in position except that now it passes around pulley 314 rather than pulley 120. The hydraulic hoses (not shown) are installed to connect pump 300 to whatever device is to be powered. Using adapter 302, the total installation time for pump 300 on engine 100 is reduced to about 1 hour.

Adapter 302 is one of many possible configurations specially shaped to match brackets 108 and 110. In this exemplary embodiment adapter 302 is made by forming a rectangular ¼" or thicker steel plate into a channeled or recessed configuration with a flat base 322, two inclined transitions 314 and 316, and two flat wing portions 318 and 320. Base 322 is a flat rectangular steel plate. Transitions 314 and 316 are two inclined steel plates integral with and extending upwardly and outwardly from opposite edges of base 312. Wing plates 318 and 320 are two flat steel plates integral with and extending outwardly from opposite outer edges, respectively of transitions 314 and 316. Wing plate 318 has two holes configured to match holes 308 and 310 of bracket 108. Wing plate 320 has one hole configured to match hole 312 of bracket 108. Base 322 has two holes 330 and 332 configured to match two similar holes (not shown) in the bottom of accessory 300 and to receive bolts 306. Adapter 302 is thus configured to allow accessory 300 to be attached to bracket 108 in substitution of alternator 104. Transitions 314 and 316 cause base 322 to be depressed relative to wing plates 318 and 320 so that base 322 can fit into a depression in bracket 108. This allows accessory 300 and adapter 302 to be mounted onto bracket 108 without accessory 300 interfering with closing of the hood (not shown) of the truck (not shown) in which engine 100 is located. Adapter 302 could alternatively be mounted in optional bracket 110 in place of alternator 106, but, where accessory 300 is a hydraulic pump, that is less desirable since it is much harder to route hydraulic lines under engine 100 than above engine 100.

Adapter 302 can be modified if needed to fit a different alternator or accessory-mounting bracket. For example, base 322, transitions 314 and 316, and wing plates 318 and 320 can be curved, shortened, lengthened, thickened or thinned if that fits the shape of the mounting bracket 108 better.

Figure 4:
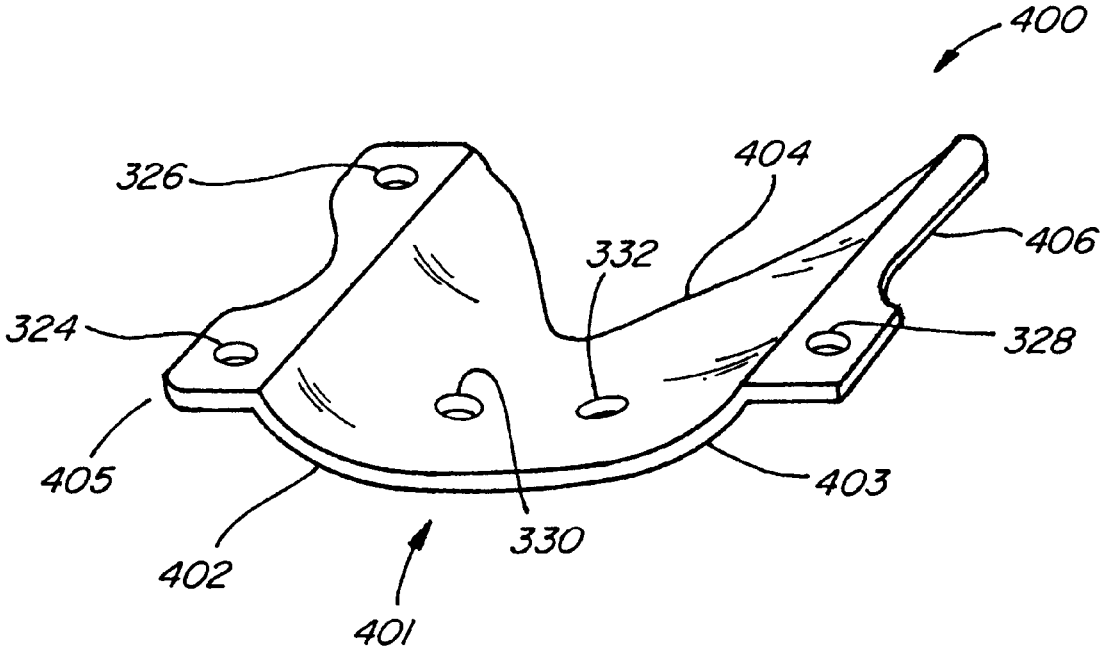
FIG. 4 is a perspective view of an alternative exemplary curved accessory mounting bracket.

FIG. 4 is a perspective view showing one such alternative exemplary adapter 400. Adapter 400 has a vertically curved base 401 and two vertically curved transitions 402 and 403 connecting base 401 to horizontally curved wing plates 405 and 406, and baseplate 401 has a horizontally curved rear portion 404, all with the purpose of minimizing the amount of metal and eliminating sharp corners.

Exemplary adapter 302 is customized for a 1997–2000 7.3 liter FORD®, INTERNATIONAL®, or NAVISTAR® diesel engine using only OEM components. If the accessory mounting bracket for any vehicle engine is different from those three, then the shape of adapter 302 would be modified to adapt. Likewise, if the accessory fastener portions are studs rather than bolt holes, are different in number than two, are spaced or sized differently, or are recessed or extended, the base could be modified within the scope of the appended claims to adapt to such modifications.

While the invention has been described in terms of various specific embodiments, those skilled in the art will recognize that the invention can be practiced with modification within the spirit and scope of the claims.

What is claimed is:

1. A method of installing a belt driven accessory on an internal combustion engine, which consists essentially of the steps of:

a.) obtaining said engine with an OEM dual alternator installation having two OEM alternator mounting brackets, each bracket configured to receive an alternator;

b.) attaching the accessory to an adapter;

c.) attaching said adapter, with the accessory attached thereto, to one of said two alternator mounting brackets, in place of an alternator which might have otherwise been attached to said one bracket; and d.) placing a single OEM drive belt in operative position to drive said accessory attached to one of said OEM alternator mounting brackets and an alternator attached to the other of said OEM alternator mounting brackets.

2. The method of claim 1, wherein the engine has a crankshaft pulley and an alternator pulley, the accessory has a pulley, and said adapter bracket is configured so that attaching said accessory to said bracket and attaching said adapter to said other bracket automatically aligns said drive pulley aligned with the crankshaft pulley and alternator pulley of the engine, so that said OEM drive belt used to power the alternator can be used to power the accessory.

3. An adapter for mounting a belt driven accessory on an internal combustion engine of a motor vehicle having an alternator mounted in a recessed bracket, which comprises:

a base plate with a plurality of apertures configured to match corresponding fastener portions of the accessory;

a pair of outwardly and upwardly inclined transition members affixed to opposed outer edges of said base plate; and a pair of wing plates, one attached to each transition, extending outwardly from opposed edges of said transition, each wing plate configured with at least one aperture matching a bolt hole of the recessed bracket so as to allow the adapter to be mounted onto the recessed bracket.

4. The adapter of claim 3, wherein one of the pair of wing plates has two of said apertures and the other of the pair of wing plates has only one of said apertures.

5. The adapter of claim 4, wherein the wing plates are flat.

6. The adapter of claim 5, wherein the base plate is flat.

7. The adapter of claim 4 wherein the base plate is curved.

* * * * *